US010112066B2

(12) United States Patent
Heathfield et al.

(10) Patent No.: US 10,112,066 B2
(45) Date of Patent: Oct. 30, 2018

(54) OCCUPATIONAL THERAPY DEVICE

(71) Applicant: AJL LLC, Grand Rapids, MI (US)

(72) Inventors: Amy De Maagd Heathfield, Coopersville, MI (US); Julie M. DeBoer, Byron Center, MI (US); Leo G. DelCarmen, II, Grand Rapids, MI (US)

(73) Assignee: AJL LLC, Byron Center, MI (US)

( * ) Notice: Subject to any disclaimer, the term of this patent is extended or adjusted under 35 U.S.C. 154(b) by 43 days.

(21) Appl. No.: 15/428,208

(22) Filed: Feb. 9, 2017

(65) Prior Publication Data

US 2018/0221698 A1 Aug. 9, 2018

(51) Int. Cl.

| | |
|---|---|
| ***A63B 71/00*** | (2006.01) |
| ***A63B 21/00*** | (2006.01) |
| ***A63B 23/035*** | (2006.01) |
| ***A63B 21/012*** | (2006.01) |
| ***A63B 21/22*** | (2006.01) |

(52) U.S. Cl.

CPC ..... *A63B 21/00069* (2013.01); *A63B 21/012* (2013.01); *A63B 21/22* (2013.01); *A63B 21/4035* (2015.10); *A63B 23/03516* (2013.01); *A63B 2213/00* (2013.01)

(58) Field of Classification Search

CPC ..... A63B 21/0006; A63B 21/40; A63B 21/01; A63B 21/22; A63B 23/035

See application file for complete search history.

(56) References Cited

U.S. PATENT DOCUMENTS

| | | | | |
|---|---|---|---|---|
| 6,149,612 | A | 11/2000 | Schnapp et al. | |
| 8,938,289 | B2 * | 1/2015 | Einav | A61B 5/0484 600/544 |
| 2009/0221928 | A1 * | 9/2009 | Einav | A61B 5/0484 600/544 |
| 2015/0313793 | A1 * | 11/2015 | Lee | A61F 2/58 434/257 |
| 2016/0067548 | A1 * | 3/2016 | Shiao | A63B 21/4035 482/5 |

FOREIGN PATENT DOCUMENTS

| | | |
|---|---|---|
| CN | 100386063 | 5/2008 |
| DE | 102006013877 | 9/2007 |

* cited by examiner

*Primary Examiner* — Garrett Atkinson

(74) *Attorney, Agent, or Firm* — Warner Norcross + Judd LLP

(57) ABSTRACT

A device and method for alleviating extremity pain and improving range of motion using a mobile mirror with functional activity attachments. Secured symmetrical functional objects for manipulation are positioned either along side, in front, or on the mirror itself. The individual looks at the reflection of the non-affected extremity manipulating the functional attachment while both extremities perform the activity. The occupational therapy device is simple to use and can relocate to either tabletop or floor. The large mirror accommodates longer arms and legs for improved visual field and can be rotated for either vertical or horizontal orientation.

20 Claims, 14 Drawing Sheets

OCCUPATIONAL THERAPY DEVICE

BACKGROUND OF THE INVENTION

The present invention relates to occupational therapy and more particularly to devices used in occupational therapy, including mirror therapy.

Current literature supports the use of mirror therapy in upper extremity rehabilitation for individuals with chronic regional pain syndrome, stroke, fractures, arthritis, and amputation (Ramachandran & Altschuler, 2009). Thieme H, Mehrholz J, Pohl M, Behrens J, and Dohle C. (2012) performed a systematic review of mirror therapy interventions versus other therapeutic treatment interventions in individuals with strokes. The authors found that mirror therapy had significant effects for upper extremity motor function and significant positive pain effects compared with the other interventions.

Research also supports the use of functional activities in upper extremity rehabilitation to increase range of motion, reduce pain, and improve function to a greater degree than rote exercise alone (Block, Smith, & Nelson, 1989; Cooper, Paquette, Moorhead & Evarts, 1996; Hsieh, Nelson, Smith, & Peterson, 1996; King, 1993; Kircher, 1984; Lang, Nelson, & Bush, 1992; Nelson, Konosky, Fleharty, Webb, Newer, Hazboun, Fontane, & Licht, 1996; Reppart, 2004; Steinbeck, 1986; Sietsema, Nelson, Mulder, Mervau-Scheidel, & White, 1993; Thompson, 1996; Toth-Fejel, Toth-Fegel, & Hendricks, 1998; Trombly & Wu, 1999; Yoder, Nelson, & Smith, 1989; Yuen, Nelson, Peterson, & Dickinson, 1994). The current use of mirror therapy affords reciprocal rote exercise (e.g. both hands performing the same motions), but makes reciprocal functional activities (e.g. both hands performing the same task) difficult. Individuals use visual, proprioceptive (body position in space), and tactile (touch) feedback for correct hand placement and manipulation of unsecured objects. For example, objects commonly used with mirror therapy treatment are theraputty, sponges and balls. During mirror therapy treatments, the mirror by design obscures the view of the affected/injured extremity. Therefore, execution of correct hand placement for reaching is impaired. If the affected extremity has decreased sensibility (ability to feel) and no visual feedback, the ability to manipulate objects becomes even more impaired. The objects commonly used with mirror therapy are limited in their application to real-life scenarios, as well. For example, there are very few one-handed exercises or functional activities performed with theraputty, balls, and sponges. Space can affect object manipulation. Some commercial mirrors fold up into a triangle and the affected hand is placed inside the triangular tunnel. The small triangular shape limits object manipulation. The hand, wrist, and forearm can only move within the confines of the mirror walls.

SUMMARY OF THE INVENTION

The present invention provides an occupational therapy device having a mirror and functional components so that manipulation of the non-affected side moves the affected side consistent with the image in the mirror. In one embodiment, device includes a pair of functional components that are situated on opposite sides of the mirror—one on the visible side for manipulation by the non-affected body part and another on the hidden side for engagement with the affected body part. The functional components may be positioned symmetrically on opposite sides of the mirror. The two functional components may be operatively joined by a linkage that causes the hidden functional component to move in a manner consistent with the reflected image of the non-affected body part. For example, in the context of a rotating functional component when the non-affected functional component is turned clockwise, the linkage may move the affected functional component in a counter-clockwise direction.

In one embodiment, the linkage may include a wheel assembly that is movably seated in a track disposed inside the mirror. The wheel assembly may include attachment points that are accessible from opposite sides of the mirror. A first functional component may attach to the wheel assembly from the visible side of the mirror for use by the non-affected limb and a second functional component will attach to the wheel assembly from the hidden side of the mirror for use by the affected limb. In use, the patient may manipulate the functional components to move the wheel assembly back and forth along the track. The wheel assembly provides a linkage that ensures the affected limb will move in a manner consistent with the image of the non-affected limb reflected by the mirror. It also allows the non-affected limb to assist in moving the affected limb.

In one embodiment, the device includes interchangeable functional components. To illustrate, the device may include a wide range of functional attachments that can be used to carry out physical movements that emulate motor activities encountered in day to day life. For example, the device may configured to receive interchangeably receive screwdriver handles, T-grip handles, hand plates, door knobs, lock and key sets, levers, ratchets, disks, switches, paddles and handles with brakes. The device may be provided with structure to secure the functional attachments.

In one embodiment, the functional attachments may include structure for securing a patient to the functional attachment. For example, in one embodiment, the functional attachments may include straps that can be fastened about a patient's limb (e.g. hand or foot) to secure that limb to the attachment. This may be particularly beneficial in situations where a patient has lost sensation in the limb.

In one embodiment, the device is configured to allow variation in the resistance of functional components. In one embodiment, the linkage may be adjustable to provide variation in resistance. For example, in one embodiment, the linkage may be a chain of gears and an adjustable tension brake may be engaged with one or more of the gears. The adjustable tension brake may be a simple screw that can be threaded into engagement with one of the gears, but other mechanism for changing tension may be used in the alternative.

In one embodiment, the linkage between the functional components can be selectively disengaged. For example, one or more elements of the linkage may be removed so that actuation of one functional component does not directly move the paired functional component. This functionality may be particularly useful as therapy progresses and direct assistance of the affected part is no longer prescribed. In one embodiment in which the linkage is a chain of gears, disengagement may be achieved by removing, shifting or otherwise disengaging one of the gears. In another embodiment, the device may include alternative attachments that are not engaged with the linkage. For example, in one embodiment, the device may include one attachment with an input that is keyed or otherwise shaped to operatively engage with the linkage and another attachment with a non-keyed input that does not operative engage with the linkage.

In one embodiment, the mirror may be movable so that it can be placed in various orientations to facilitate a wide range of therapies. For example, the device may include a removable stand (or pair of stands) that can be selectively affixed to the mirror to hold it in different orientations. In one embodiment, the stands may be frictionally fitted onto the long or short sides of the mirror. In another embodiment, the stands may be secured to the mirror by fasteners. Alternatively, the stand(s) may be an integral part of the mirror. In yet another alternative embodiment, the functional components and associated linkage may be contained in a housing that is capable of being positioned on edge or flat on a support surface. The housing may be configured to receive and support the mirror in different orientations. For example, the housing may include a seat capable of receiving a horizontal or vertical edge of the mirror. The seat may be configured to firmly receive an edge of the mirror by a frictional fit. In use, this arrangement may be configured to allow the mirror and the housing to be positioned in horizontal or vertical orientations.

In one embodiment, the mirror may be removed from the device, thereby allowing the patient to directly observe the affected and non-affected body parts. This functionality may be included to expand the capabilities of the device and allows its use outside of mirror therapy.

In one embodiment, the device may include a handle and brake attachment. The handle and brake attachment may include a separate tensioning assembly that biases the brake lever in the extended position and supplies the desired resistance. If desired, the tensioning assembly may be adjustable to vary the resistance of the brake lever. In this embodiment, the tensioning assembly may be configured so that actuation of the brake on the non-affected side reduces the resistance of the brake lever on the affected side.

The present invention provides a simple and effective mirror therapy device that provides symmetrical functionality and is capable of being adapted for use with a wide range of physical exercises. The mirror therapy device of the present invention allows for greater degrees of freedom for movement patterns. Through the use of a symmetrical linkage, the present invention provides symmetrical functional objects for manipulation on either side of the mirror to facilitate symmetrical functional use of bilateral extremities using improved proprioceptive cues. The symmetrical linkage ensures that the affected body part moves in a manner consistent with the reflected image of the non-affected body part shown in the mirror. This increases neural activity in the brain facilitating a normal movement pattern. The present invention may be configured so that it can be readily adapted for use with a wide range of therapies. For example, interchangeable functional attachments can be provided. As another example, the mirror and attachment structure may be configured so that they can be mounted in a range of different positions and orientations to facilitate greater differentiation. By allowing the use of common objects disposed symmetrically with respect to a less restrictive mirror, the present invention can be implemented in a way that rectifies a number of issues associated with prior art devices and allows object manipulation, increased application to daily life activities, increase neural activity, and improved motor control. To provide greater adaptability, the device may be configured to allow disengagement of the symmetrical linkage, if desired. Further, the device may be provided with adjustable resistance so that greater resistance to movement of the attachments may be achieved as the patient progresses.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

A. Overview.

Utilization of a variety of functional tasks with mirror therapy may resolve problems stated in the background. In one embodiment, the present invention aims to provide secured symmetrical functional objects for manipulation on either side of the mirror and facilitate symmetrical functional use of bilateral extremities using improved proprioceptive cues. Often times after an injury, an individual may not have an accurate localization of touch or knowledge of where the affected extremity is in relation to her/his environment. Individuals use vision to accurately motor plan and execute grasping of an object. When these three sensations are impaired during the use of mirror therapy, decreased functional use of the affected limb occurs. In occupational therapy, meaningful and purposeful activities are used as a therapeutic modality to improve functional use. These activities are graded to improve function. Since the individual with the affected limb has difficulty with manipulating objects, the therapist places the affected limb on the functional attachment and is secured with a strap on the non-mirrored side. The non-affected extremity is placed on the functional attachment on the mirrored side. The functional attachments are connected so that when the non-affected side moves, it moves the affected side consistent with the image in the mirror. For example, if the individual's non-affected side turns the door handle clockwise, the affected side will turn the door handle counter-clockwise to match the image in the mirror. The individual will look into the mirrored side and see what appears to be the affected side moving normally. As the client progresses, the straps may be removed, attachments may be changed, connection removed between affected and non-affected attachments, and resistance added to attachments while using the mirror. Practice intensity and task specificity are important factors in achieving neural plasticity. High repetitions of non-purposeful activity as seen with current use of mirror therapy may not be sufficient to induce long-term cortical changes and improved functional outcomes. Clients need to practice functional activities to achieve maximum functional outcomes.

Figure 1:
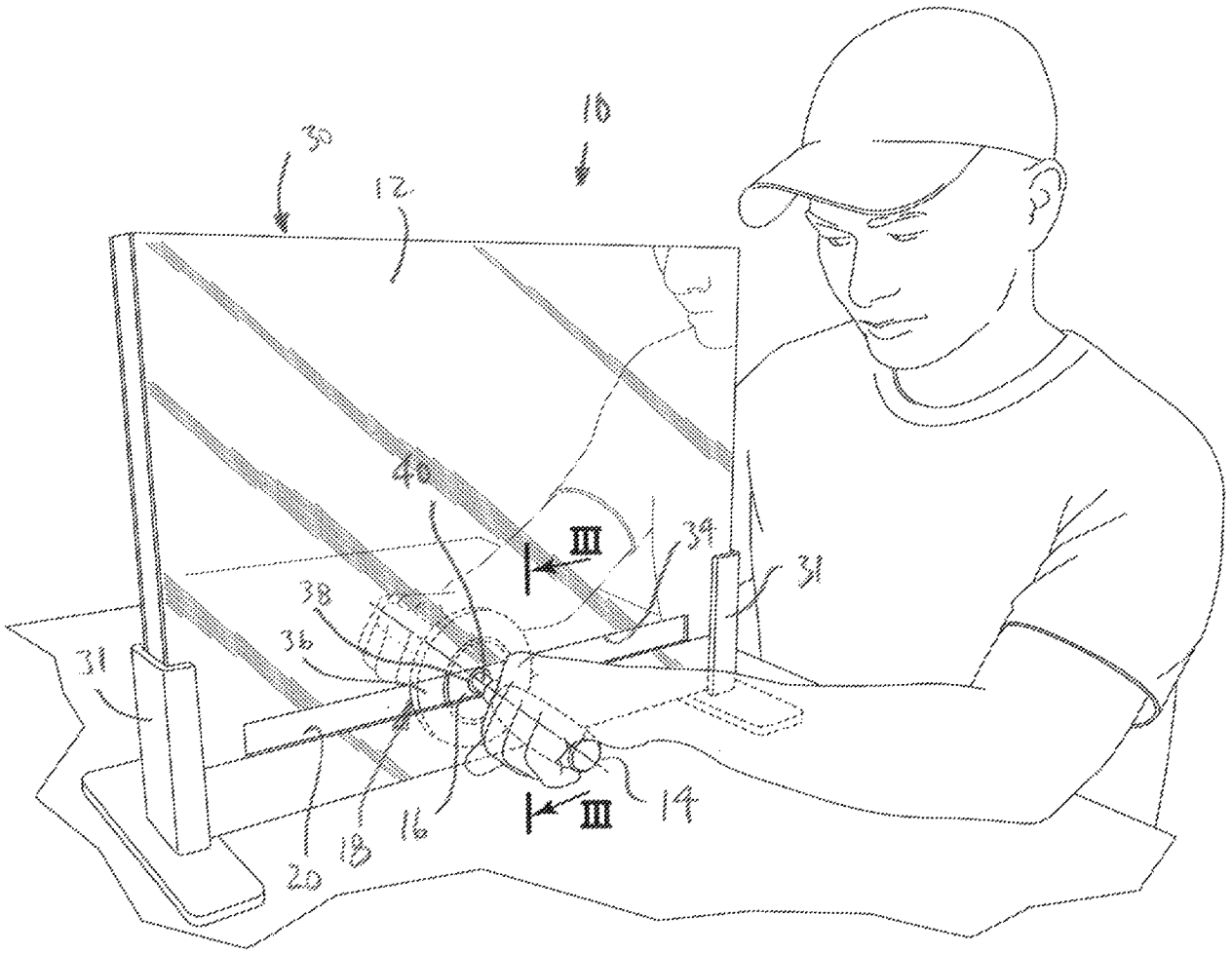
FIG. 1 is a perspective view of a patient using an embodiment of the present invention with the device in one orientation.
Figure 2:
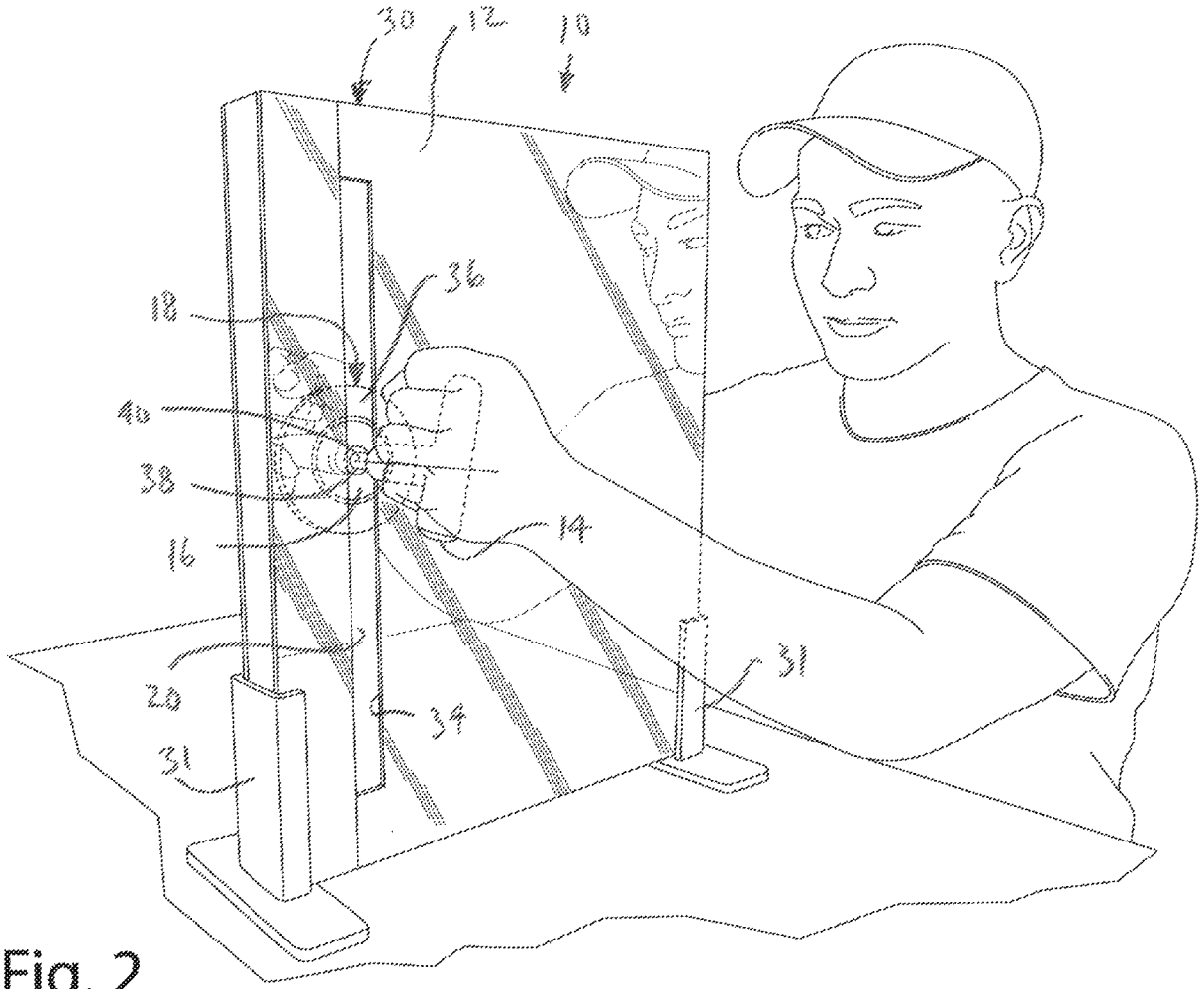
FIG. 2 is a perspective view of a patient using the device in an alternative orientation.
Figure 6:
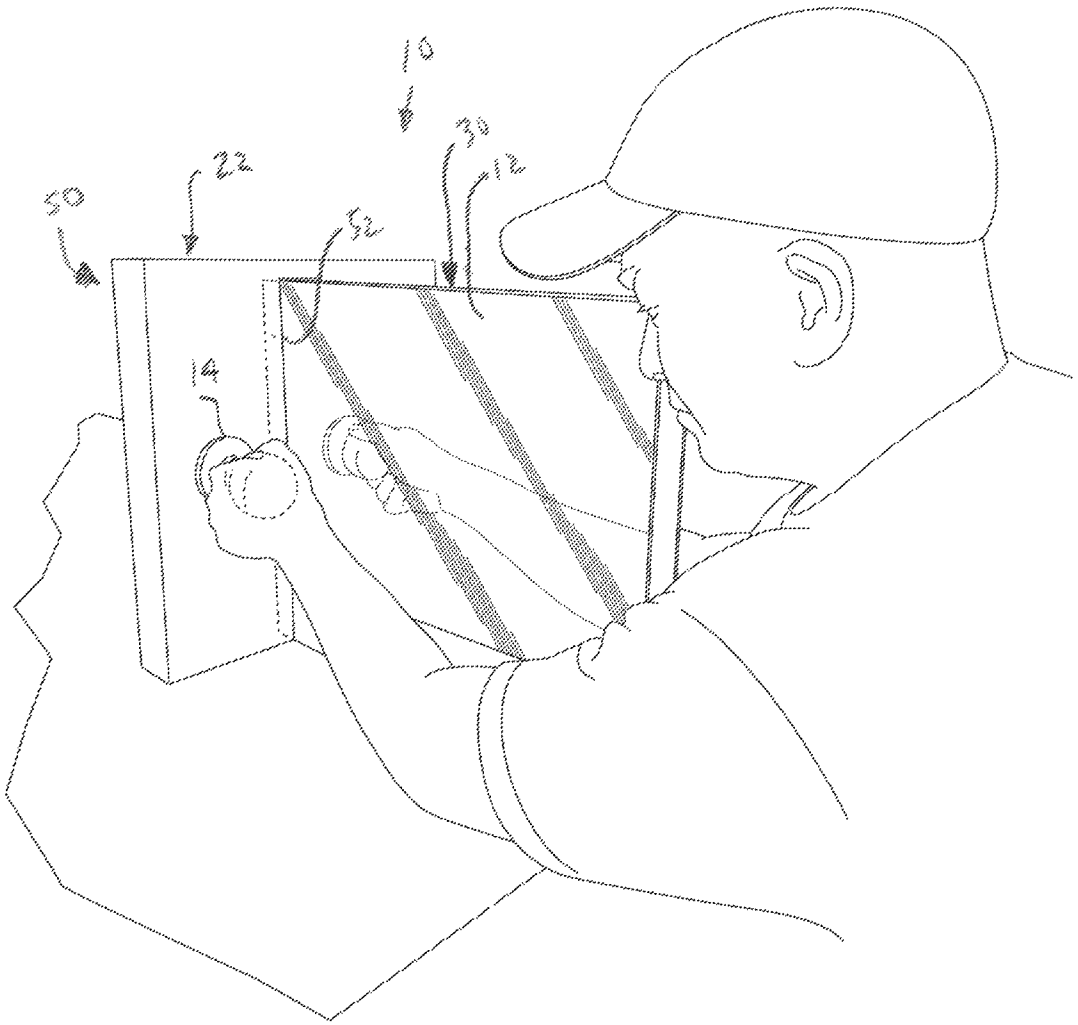
FIG. 6 is a perspective view showing a patient using the device with a door handle attachment positioned in a vertical orientation.
Figure 7:
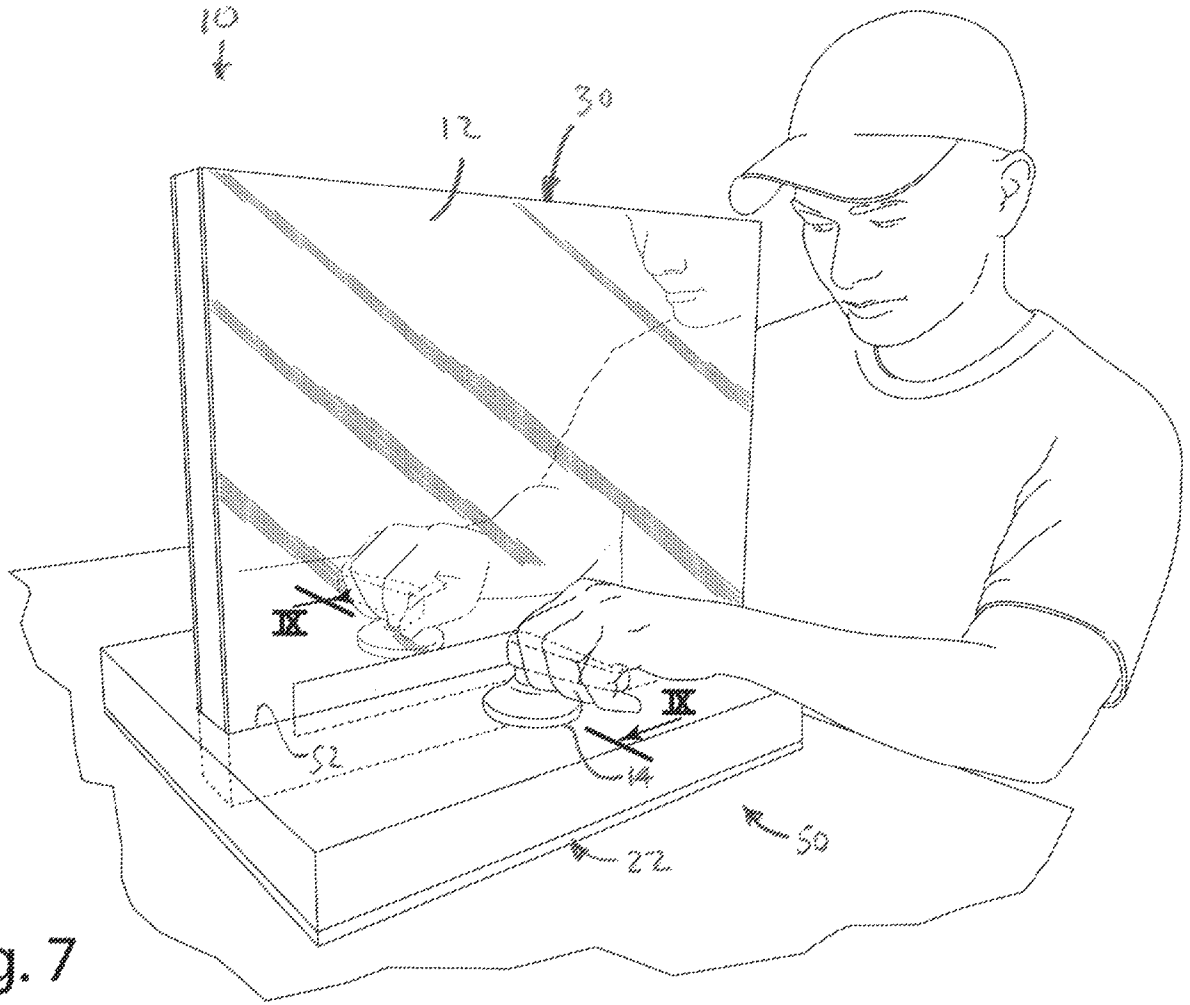
FIG. 7 is a perspective view showing a patient using the device with a lever attachment positioned in a horizontal orientation.

A mirror therapy device in accordance with an embodiment of the present invention is shown in FIGS. 1 and 2. The mirror therapy device 10 includes a mirror 12, a pair of functional components 14 situated on opposites sides of the mirror 12 and a linkage 16 joining the functional components. In the embodiment, the linkage 16 includes a wheel assembly 18 movably seated within a track 20 in the mirror 12. The wheel assembly 18 supports the functional components 14 so that the patient can move the functional components forward and rearward along the track 20. In use, the linkage 16 operatively connects the functional components 14 so that movement of one functional component 14 by the non-affected limb on the visible side of the mirror 12 results in symmetrical movement of the affected limb on the hidden side of the mirror 12. As a result, the affected limb moves in a manner consistent with the image of the non-affected limb reflected by the mirror 12. The device 10 may include a wide range of interchangeable functional components that allow a variety of therapeutic movements. In addition or as an alternative to the wheel assembly 18, the device 10 may include a separate symmetrical linkage that operatively couples additional functional components. For example, FIGS. 6 and 7 show a separate housing 22 that is configured to support a wide range of functional components and can be removably joined to the mirror 12. The housing 22 may contain a symmetrical linkage 24 that joins the functional components on opposite sides of the mirror 12 so that movement of one functional component 14 by the non-affected limb on the visible side of the mirror 12 results in symmetrical movement of the affected limb on the hidden side of the mirror 12. In some applications, the linkage may be removed so that the affected and non-affected limbs move independently. In some applications, the device may include structure to vary the resistance of the functional components, which may be used to assist in developing strength in the affected limb.

Although described in the context of illustrations showing various embodiments of a mirror therapy device intended for use in occupational therapy of upper extremities, such as hands, wrists, elbows, shoulders and arms, the present invention may be readily adapted for use with other body parts. For example, a mirror therapy device may be configured for use in performing rehabilitation of lower extremities, including feet, ankles, knees, hips and legs.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

B. Mirror Therapy Device.

Figure 3:
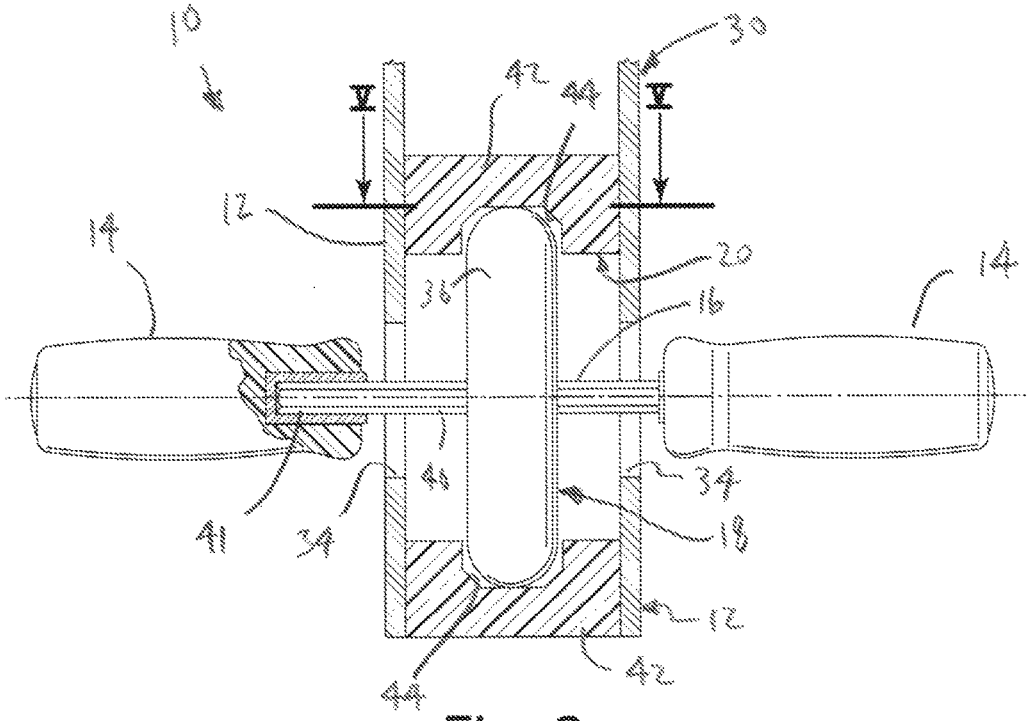
FIG. 3 is a partially sectional view of a portion of the device showing screwdriver handles affixed to opposite sides of a wheel linkage.

The mirror therapy device 10 of FIG. 1 is configured to allow a patient to perform rehabilitation of upper extremities using a range of functional activities. As noted above, the device 10 generally includes a mirror 12 (which includes conventional mirrors and other reflective surfaces), a wheel assembly 18 and a pair of functional components 14 situated on opposites sides of the mirror 12. In this embodiment, the mirror 12 is affixed to one side of a mirror housing 30. The mirror 12 of this embodiment is largely coextensive with the mirror housing 30, but it may alternatively cover only a portion of the mirror housing 30. In this embodiment, the mirror housing can be rotated lengthwise to allow the mirror to face left for use in right side therapy or to face right for use in left side therapy. Although not shown, a second mirror may be affixed to the opposite side of the mirror housing 30 so that it can provide left side and right side therapy without rotation. The mirror housing 30 of this embodiment includes a track 20 that is configured to receive the wheel assembly 18. The track 20 of this embodiment includes two cooperating track members 42 that are situated between opposed major surfaces of the mirror housing 30 (See FIG. 3). The height, length and width of the track 20 and track members 42 may vary from application to application to accommodate different wheel assemblies and to provide the desired range of motion. The mirror housing 30 may define a pair of apertures 34 disposed along opposite side of the track 20. As discussed in more detail below, the apertures 34 may be configured to allow access to opposite sides of the wheel assembly 18.

Figure 5:
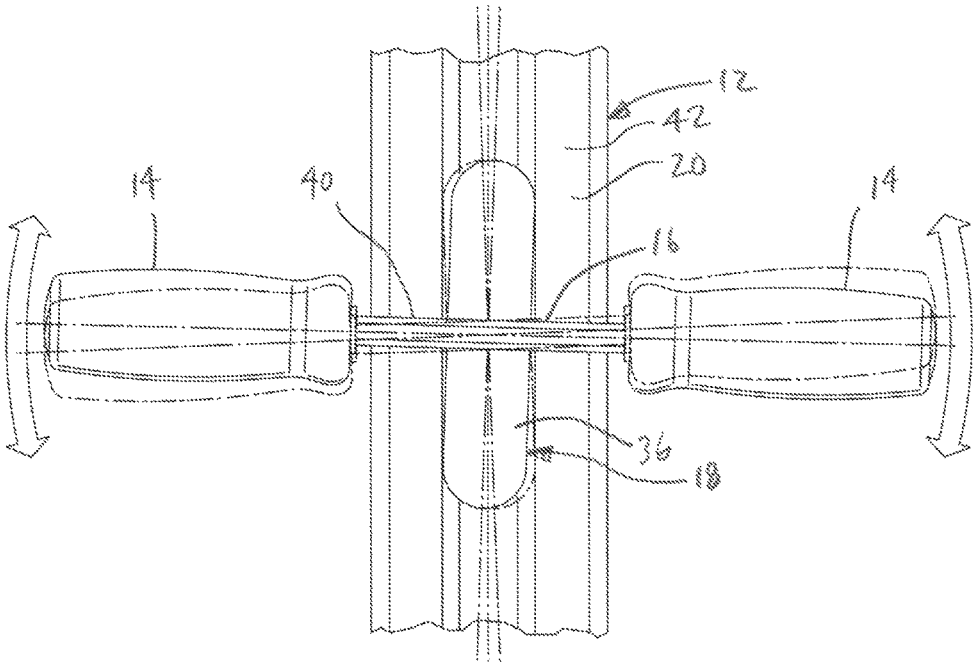
FIG. 5 is a partially sectional view of the device showing illustrating a degree of play between the wheel linkage and its corresponding track.

In this embodiment, the wheel assembly 18 includes a wheel 36, a central bearing assembly 38 and a shaft 40. The wheel 36 is configured to be closely received with in the track 20. In the illustrated embodiment, the distance between the track members 42 is slightly greater than the diameter of the wheel 36 so that the wheel 36 can be easily moved along the track 20. This distance may be varied to affect the amount of force required to move the wheel assembly 18 along the track 20. Referring now to FIG. 5, the track 20 may include a wheel slot 44 that is slightly wider than the wheel 36 to allow some play while reducing the risk of binding. The central bearing assembly 38 is configured to receive the shaft 40 and to allow smooth and easy rotation of the wheel 36 about the shaft 40. The central bearing assembly 38 may be replaced by other low friction elements that facilitate rotation of the shaft 40 with respect to the wheel 36. In some applications, the shaft 40 may be configured to rotate with the wheel 36. In applications of this type, the central bearing assembly 38 may be eliminated and the shaft 40 may be keyed or otherwise immovably mounted at the center of the wheel 36. Returning now to the illustrated embodiment, the shaft 40 extends through the central bearing assembly 38 and provides a linkage between functional components 14 mounted to opposite sides of the wheel assembly 18. The shaft 40 may be permanently or removably affixed within the central bearing assembly 38. Opposed ends 41 of the shaft 40 are configured to receive interchangeable functional components 14. In this embodiment, the opposed ends 41 of the shaft 40 are shaped to provide mechanical interlock between the shaft 40 and the functional components 14. For example, the shaft 40 may have a hexagonal cross-sectional shape along its full length. Although shown with a hexagon shape, the shaft 40 may have essentially any cross sectional shape, including shapes that can be used to provide mechanical interlock and shapes that cannot. In alternative applications, the functional components 14 may be joined to the shaft 40 by a pin, set screw or other structures (not shown). In the illustrated embodiment, the length of the shaft 40 is selected to receive and support the functional components in a positioned relatively close to the mirror. The length of the shaft may vary from application to application, as desired. In some applications, it may be desirable to provide interchangeable shafts 40 that can be installed depending on the desired exercise. Although the illustrated embodiment includes a single shaft extending through the central bearing assembly 38, the shaft 40 may be formed from separate shaft segments. For example, the shaft 40 may include separate segments that attach to the wheel assembly 18 from opposite sides (not shown).

Figure 4:
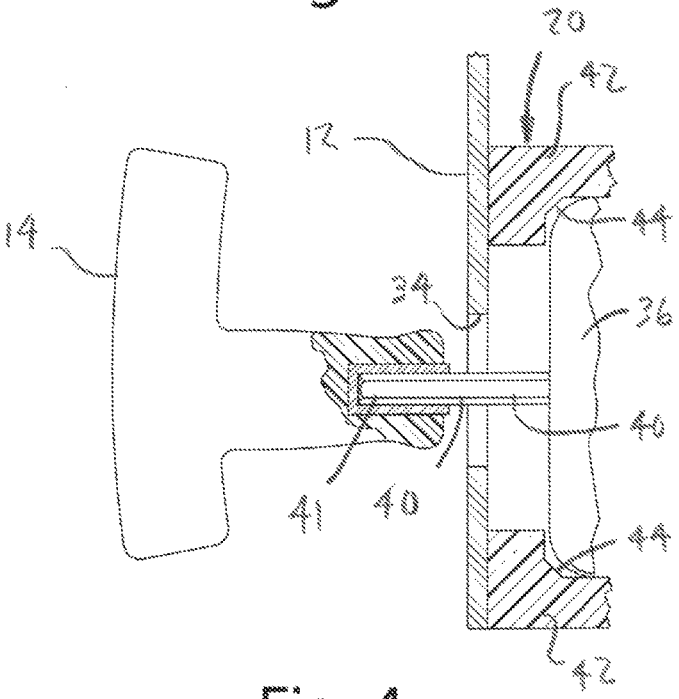
FIG. 4 is a partially sectional view similar to FIG. 3 showing an alternative functional attachment affixed to the wheel linkage.

The wheel assembly 18 is configured to receive a wide range of interchangeable functional components 14 (or functional attachments). FIGS. 1-3 and 5 show functional components that generally correspond in size and shape with screwdriver handles. As an alternative, FIG. 4 shows a functional component in the form of a T-shaped handle. These and other detachable handle or grip options, such as hand plates and handles with brake levers, may be provided for use with the wheel assembly 18. In the illustrated embodiment, the functional components 14 are removably attached to the wheel assembly 18. As perhaps best shown in FIGS. 3 and 4, each functional component 14 may include a socket 46 that is configured to closely interfit with the shaft 40. For example, in the illustrated embodiment, the socket 46 and the shaft 40 have mating hexagonal shapes that mechanically interlock the functional components 14 to the shaft 40 with respect to rotational movement. As noted above, the shapes of the socket 46 and opposite ends 42 of the shaft 40 may vary. Although not shown, the functional components 14 and the shaft 40 may be configured to help secure the functional components 14 in place on the shaft 40. For example, each end 42 of the shaft 40 may include an annular recess and the functional components 14 may each include a spring-loaded ball that snap-fits into the annular recess when the functional component 14 is installed on the shaft 40 (not shown). As another example, a set screw or other type of fastener may be used to intersecure the functional components 14 and the shaft 40.

The mirror therapy device 10 of the illustrated embodiment allows for motion of extremities in the sagittal or transverse planes depending on placement of mirror with track in either vertical or horizontal orientations. FIGS. 1 and 2 show the mirror therapy device 10 in different orientations. In the orientation show in FIG. 1, the patient can move the wheel assembly forward and rearward along the track in a generally horizontal plane. In addition (or in the alternative), the patient can twist the functional attachments about their longitudinal axis. In the orientation of FIG. 2, the patient can move the wheel assembly up and down along the track in a generally vertical direction, and can additionally or alternatively twist the functional attachments about their longitudinal axis. As noted above, the device 10 includes a linkage 16 that operatively connects the functional components 14 so that movement of one functional component 14 by the non-affected limb on the visible side of the mirror 12 results in symmetrical movement of the affected limb on the hidden side of the mirror 12. As a result, the affected limb moves in a manner consistent with the image of the non-affected limb reflected by the mirror 12. In this embodiment, the symmetric linkage between the functional components 14 is provided predominantly by the shaft 40. As a result of the shaft 40, movement of the wheel assembly 18 along the track 20 by the non-affected limb will result in corresponding movement of the affected limb on the hidden side of the mirror 12. Similarly, rotational interlock between the shaft 40 and the functional components 14 helps to provide a symmetric linkage between the opposite functional components 14. For example, if a patient rotates a functional component 14 with the patient's non-affected limb, that rotational motion will be imparted to the other functional component 14 associated with the affected limb. This helps to further ensure that the affected limb will follow movements that are consistent with the reflected image of the non-affected limb.

To facilitate positioning the mirror housing 30 in various orientations, the mirror housing 30 may include a removable stand or pair of stands 31 that can be selectively affixed to the mirror housing 30 to hold it in different orientations. In the illustrated embodiment, the stands 31 may be frictionally fitted onto the long or short sides of the mirror housing 30 (compare FIGS. 1 and 2). The number, size, shape, configuration and arrangement of stand(s) may vary from application to application. In alternative embodiments, the stands 31 may be secured to the mirror housing 30 by fasteners. Alternatively, the stand(s) may be an integral part of the mirror housing.

The mirror therapy device 10 may be provided with a separate carrier assembly capable of supporting additional functional components. The carrier assembly may be provided as a supplement or an alternative to the wheel assembly 18 discussed above. One embodiment of a carrier assembly 50 is shown in FIGS. 6-11. FIGS. 6 and 7 show a carrier assembly 50 having a separate carrier housing 22 that can be removably joined to or otherwise associated with the mirror 12 and mirror housing 30 in a variety of different orientations. The carrier housing 22 is configured to receive functional components 14 (round door handle in FIG. 6 and lever door handle in FIG. 7) at symmetrical locations on opposite sides of the mirror 12. In this embodiment, the housing 22 contains a symmetrical linkage 24 that joins the functional components 14 on opposite sides of the mirror 12 so that movement of one functional component 14 by the non-affected limb on the visible side of the mirror 12 results in symmetrical movement of the affected limb on the hidden side of the mirror 12.

In the illustrated embodiment, the carrier assembly 50 generally includes a carrier housing 22 with mounting structure 62 for attaching functional components on opposite sides of the mirror 12. As perhaps best shown in FIGS. 8 and 9, the carrier housing 22 generally includes a base 54 and a cover 58. The base 54 and cover 58 may have essentially any suitable shape, but in this embodiment are configured to contain the mounting structure 62 and the linkage 24, and to interfit with the mirror housing 30. The carrier housing 22 is generally rectangular in this embodiment, but its shape may vary from application to application. In this embodiment, the generally rectangular shape of the carrier housing 22 allows it to rest on flat surfaces in different orientations and to interfit with the generally rectangular mirror housing 30 in different arrangements. In this embodiment, the mounting structure 62 includes a pair of shafts 64 that are rotatably mounted within the carrier housing 22. In the illustrated embodiment, each shaft 64 is seated in a boss 66 in a corresponding gear 68 (discussed below) in the symmetrical linkage 24. If desired, the shafts 64 may be mounted within bushing, bearings or other structures configured to reduce friction and provide smooth and easy rotation of the shafts 64. The shafts 64 may have a non-circular cross-sectional to facilitate rotational interlock between the functional attachments 14 and the shafts 64. For example, the illustrated shafts 64 are hexagonal in cross-sectional shape. The shafts 64 may have essentially any cross sectional shape, including shapes that can be used to provide mechanical interlock and shapes that cannot. In alternative applications, the functional components 14 may be joined to the shafts 64 by a pin, set screw or other structures (not shown). The functional components 14 and the shafts 64 may be configured to help secure the functional components 14 in place on the shafts 64. To illustrate, each shaft 64 may include an annular recess and the functional components 14 may each include a spring-loaded ball that snap-fits into the annular recess when the functional component 14 is installed on the shaft 64 (not shown). As another example, a set screw or other type of fastener may be used to intersecure the functional components 14 and the shafts 64.

Figure 8:
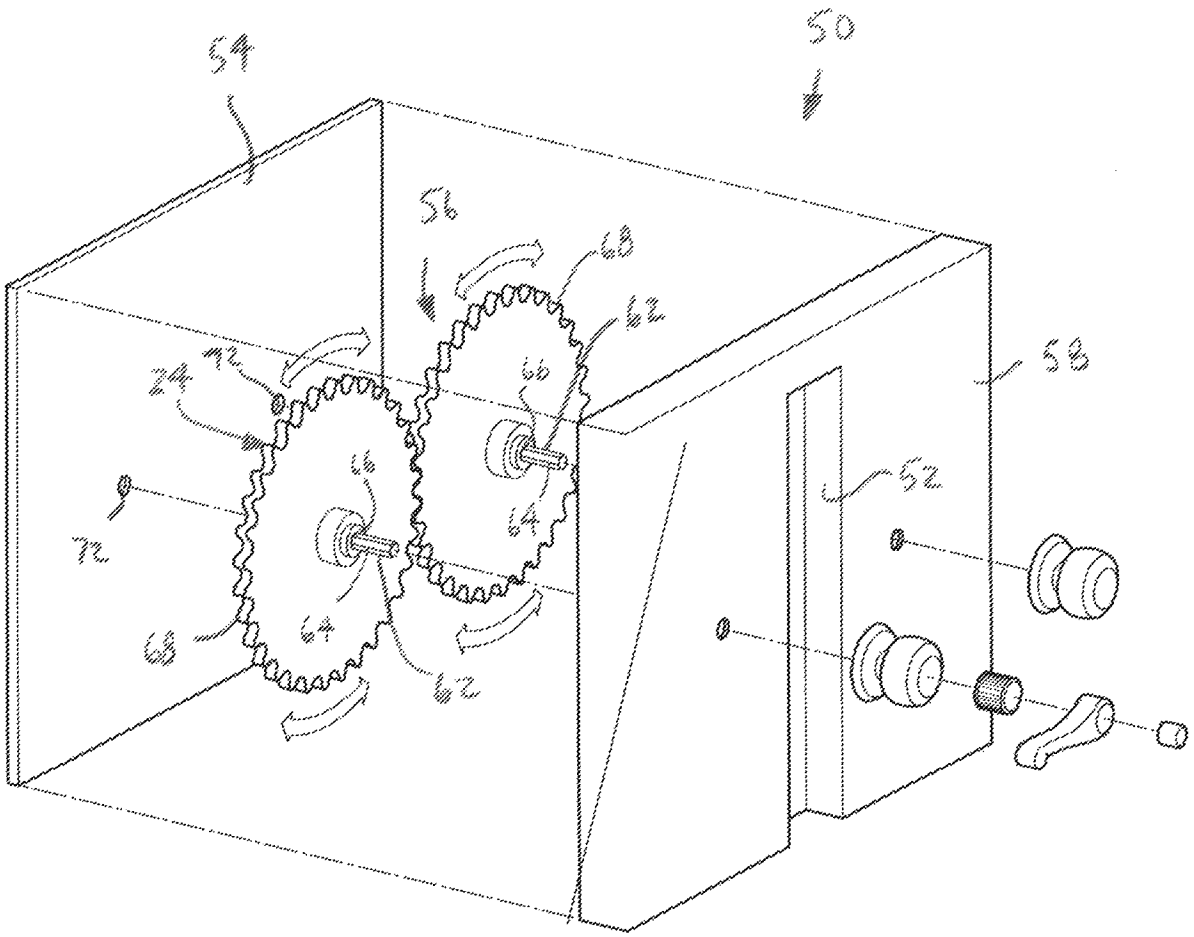
FIG. 8 is an exploded view of a linkage housing showing the symmetrical linkage and two optional functional attachments.
Figure 9:
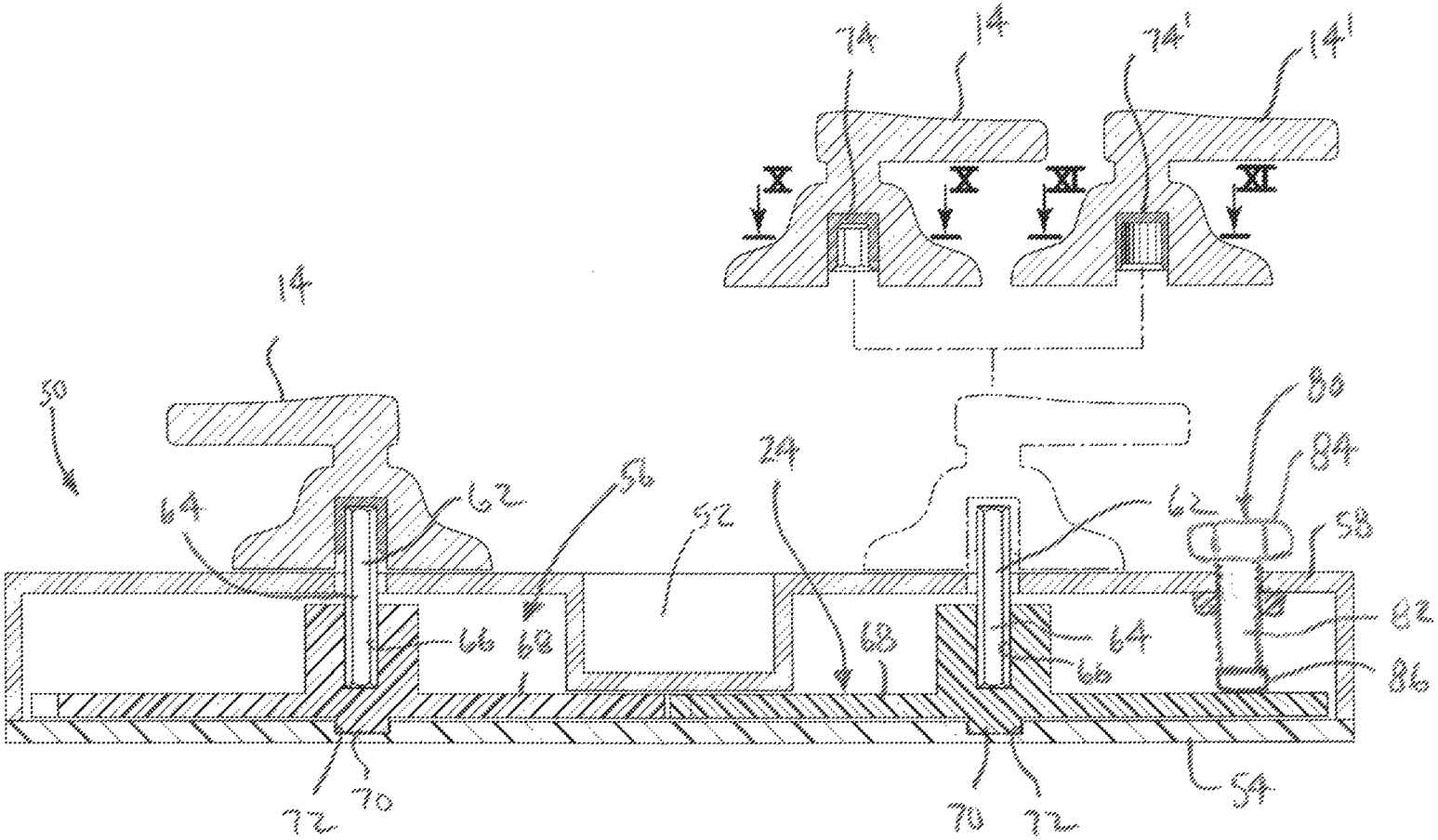
FIG. 9 is a sectional view of a linkage housing showing a keyed functional attachment and a non-keyed functional attachment.
Figure 9A:
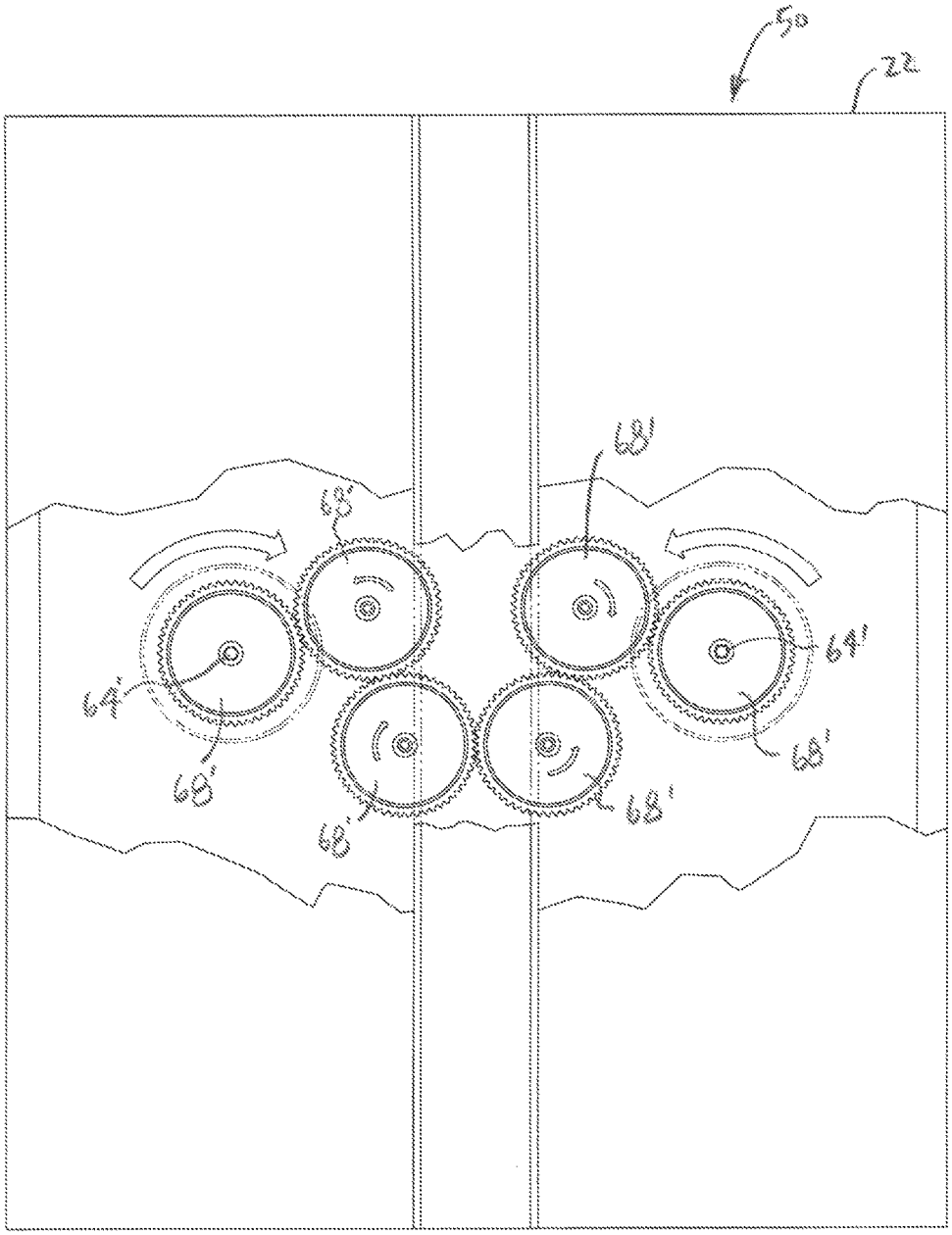
FIG. 9A is a top plan view of an alternative embodiment of the linkage housing with portions removed to showing an alternative symmetrical linkage.

The carrier assembly 50 includes a symmetrical linkage 56 that operatively couples the mounting structure for the functional components. In the embodiment of FIGS. 6-11, the linkage 56 includes a pair of mating gears 68 that are rotatably mounted within the carrier housing 22. As shown in FIGS. 8 and 9, each gear 68 may include an axle 70 that is fitted into a corresponding recess 72 in the base 54 of the carrier housing 22. The gears 68 of the illustrated embodiment are essentially identical and are mated so that clockwise rotation of one gear causes symmetrical counter clockwise rotation of the other gear (and vice versa). As a result, this linkage 56 ensures that an affect limb engaged with the hidden functional attachment 14 (or functional component) will move in a manner consistent with the image of the non-affected limb engaged with the visible functional attachment 14. Although not shown, bearings, bushings or other friction reduction components may be fitted between the gears 68 and the carrier housing 22 to facilitate rotation. In the embodiment of FIGS. 6-11, the linkage includes two mating gears. The present invention may be implemented with alternative linkages. For example, in the alternative embodiment shown in FIG. 9A, the linkage may include a chain of six smaller gears 68' that are arranged to bridge the distance between the two mounting structures 62 and to provide symmetrical rotation of the associated functional attachments 14. In this embodiment, the functional attachments 14, 14' may be attached to shafts 64' in the outermost gears 68'. The linkage need not, however, be implemented with gears. For example, the linkage may be implemented with gears, lever, cables, rack and pinion arrangements or essentially any other components capable of providing the desired symmetrical operation of the functional attachments.

Although the attachment structure may vary, the carrier assembly 50 of this embodiment defines a slot 52 configured to closely interfit with an edge of the mirror housing 30. The slot 52 may be dimensioned to receive an edge of the mirror housing 30 with a frictional fit that helps to retain them in mating engagement. Additionally or alternatively, the fasteners, such as screws, bolts or pins, may be used to intersecure the mirror housing 30 and the carrier housing 22. In this embodiment, the slot 52 is disposed near the center of the carrier housing 24 so that the mounting structures for the functional attachments are positioned symmetrically on either side of the mirror in either vertical or horizontal orientation. In use, the carrier assembly 50 of the illustrated embodiment can be joined to the mirror 12 with the carrier housing 22 extending in a generally vertical plane as shown in FIG. 6 or a generally horizontal plane as shown in FIG. 7.

The carrier assembly 50 is configured to receive any of a wide variety of interchangeable functional attachments. For example, FIG. 6 shows a conventional circular door handle attached to the carrier assembly 50. Although not shown, an identical door handle is affixed to the mounting structure on the hidden side of the mirror housing 30. As another example, FIG. 7 shows a conventional lever door handle attached to the carrier assembly 50. Again, an identical lever door handle is affixed to the mounting structure on the hidden side of the mirror housing 30. These examples are merely exemplary and additional functional attachments may have essentially any shape or styles, such as ratchets, disks, switches, and paddles. In this illustrated embodiment, the opposed ends of shaft 40 of the wheel assembly 18 and the shafts 64 of the carrier assembly 50 are essentially identical in cross-sectional shape so that the same functional attachments may be mounted to the wheel assembly 18 or the carrier assembly 50, as desired. This is not necessary, however, and different cross-sectional shapes may be provided.

Figure 10:
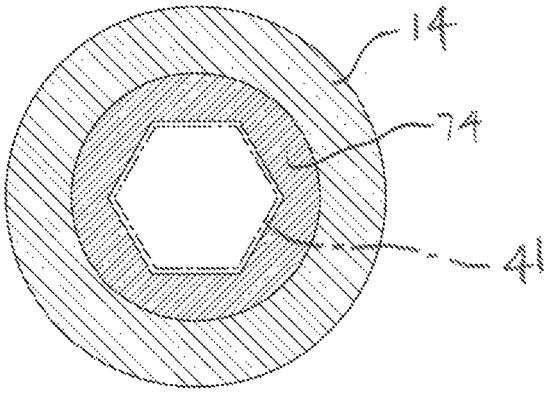
FIG. 10 is a sectional view of the keyed functional attachment fitted to the linkage.
Figure 11:
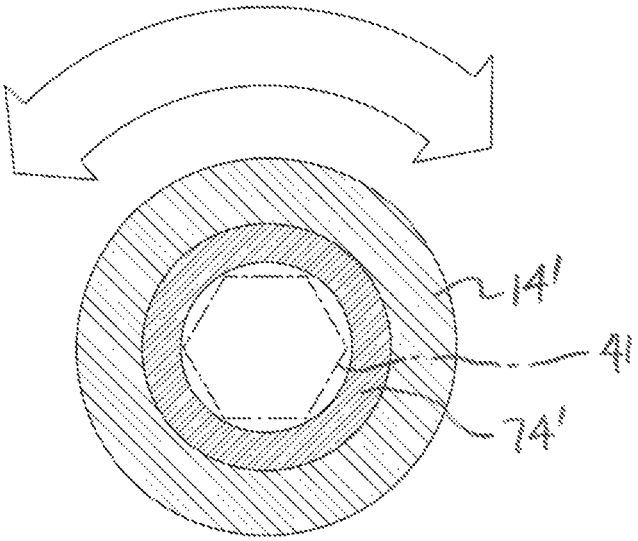
FIG. 11 is a sectional view similar to FIG. 10 showing the non-keyed functional attachment fitted to the linkage.

As noted above, the symmetrical linkage 56 includes a pair of gears 68 that ensure symmetrical motion between the two functional attachments. In some situations, it may be desirable to disengage this linkage so that the two functional attachments are not operatively linked and the affected and non-affected limbs move independently. This may be achieved by removing or shifting one or both of the gears 68. For example, the linkage may be configured so that one or both of the gears 68 may be shifted axially or radially to disengage the gears 68. In an alternative embodiment, disengagement of the symmetrical linkage 56 may be achieved by installing at least one functional attachment that is not rotationally interlocked with the mounting structure 62. Referring now to FIG. 9, an alternative functional attachment 14' may be provided with a socket 74' that is not keyed to the shape of the shaft 64. More specifically, the socket 74' of functional attachment 14' may be circular and have a diameter slightly larger than the shaft 64 so that the functional attachment 14' can rotate freely about the shaft 64. This can be seen in FIG. 9 by comparing the hexagonal socket 74 of functional attachment 14 with the circular socket 74' of functional attachment 14'. Further, FIG. 10 shows a cross-section of the hexagonal socket 74, which is configured to be rotationally interlocked with a corresponding hexagonal attachment component 41. Similarly, FIG. 11 shows a cross-section of the circular socket 74', which is configured not to be rotationally interlocked with a hexagonal attachment component 41. As an alternative to supplying alternative functional attachments, a functional attachment may be provided with interchangeable inserts that can be selectively installed in a corresponding seat in the functional attachment. For example, a functional attachment may be provided with an insert that is keyed for rotational interlock and one that is not keyed for rotational interlock. The interchangeable inserts may be frictionally fitted into the seat in the functional attachment. To provide rotational interlock, the inserts may include teeth or otherwise be keyed to the functional attachment.

In some applications, the mirror therapy device 10 may include structure to vary the resistance of the functional components, which may be used to increases or decreases the physical demand of the individual to move the attachments. This may be useful in developing strength in the affected limb. In the context of mirror therapy device 10, a resistance component is added to the carrier assembly 50. The resistance component may engage the mounting structure 62 or the linkage 56, but in the embodiment of FIG. 9 is engaged with one of the gears 68. In this embodiment, the resistance component 80 is a threaded component that is threaded through the carrier housing 24 and can be selectively engaged with a gear 68. The illustrated resistance component 80 generally includes a threaded shaft 82 having an exposed knob 84 on one end and a brake-like tip 86 on the other. In use, the resistance component 80 can be tightened against the gear 68 to increase resistance and loosened to decrease resistance. This resistance component is merely exemplary and the device 10 may include alternative structure capable of varying resistance. For example, resistance elements from conventional workout equipment can be incorporated into the mirror therapy device, such as elastic bands joined to moving components or nylon straps capable of being increasingly tightened about rotating parts. Although the resistance component is described in the context of the carrier assembly 50, a resistance component can additionally or alternatively be added to the track 20 or the wheel assembly 18, if desired.

Figure 12:
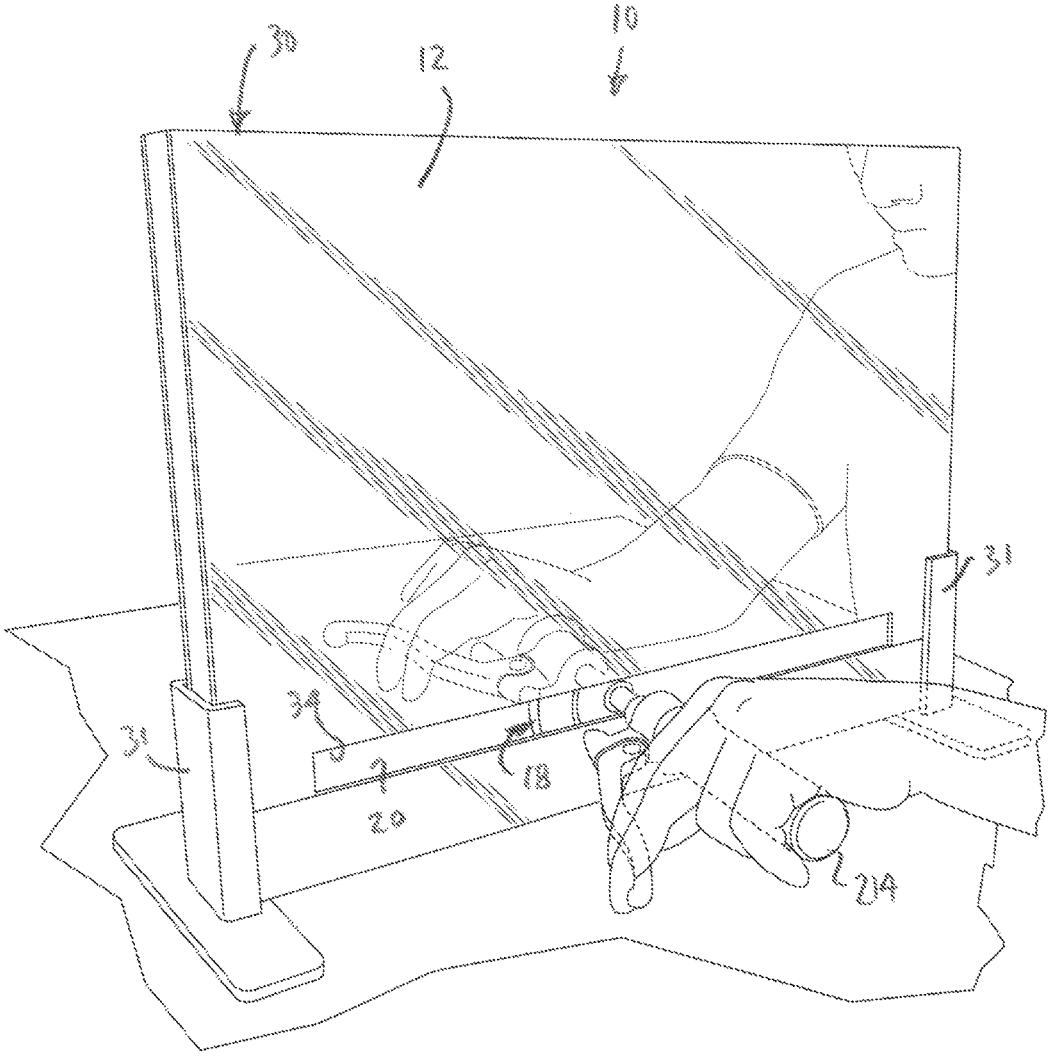
FIG. 12 is a perspective view of a patient using the device with handle and brake lever functional attachment.
Figure 13:
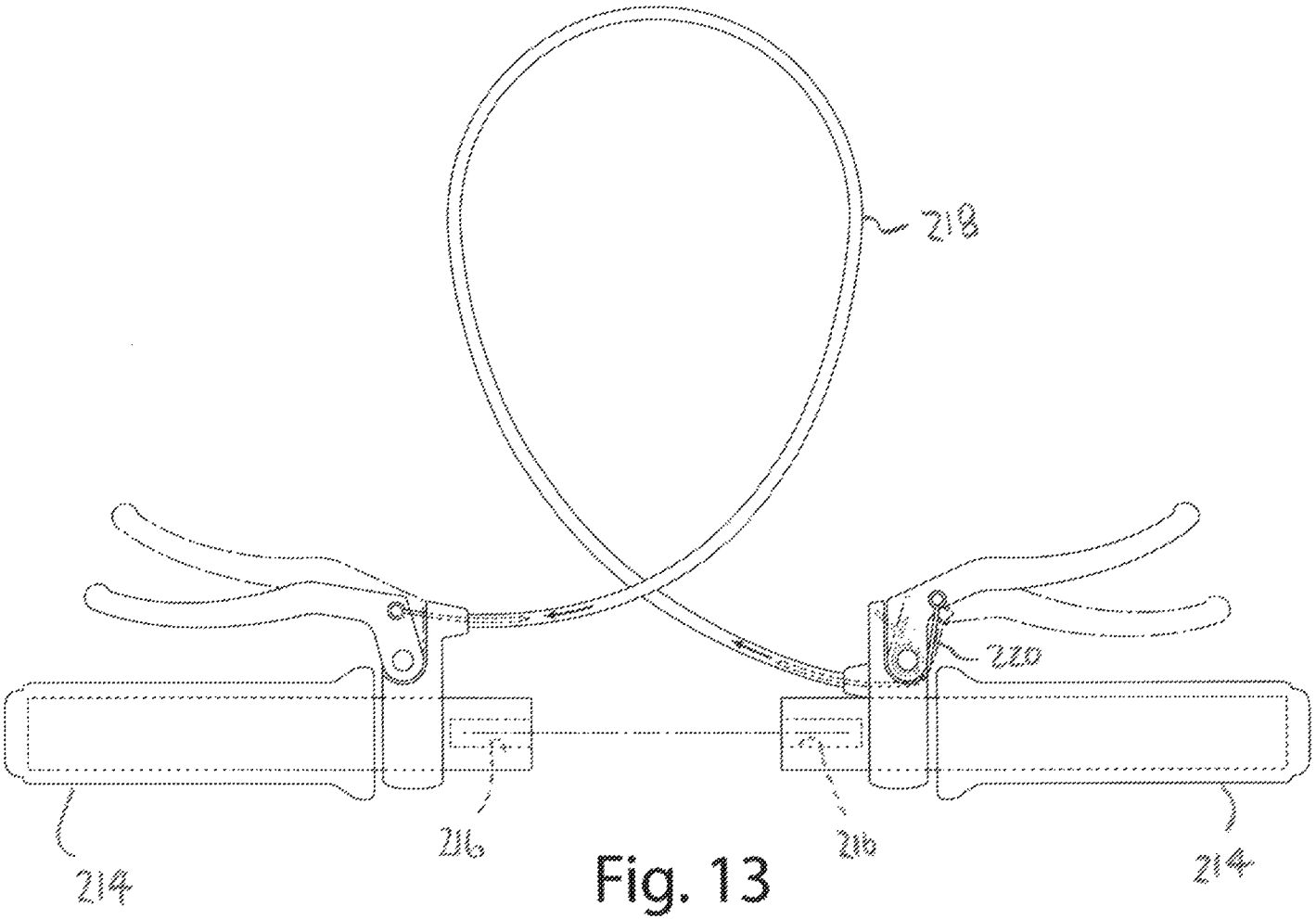
FIG. 13 is an illustration showing a linkage that provides symmetrical operation between opposed brakes.

As noted above, the mirror therapy device 10 is configured to receive a wide range of functional attachments. In the illustrated embodiment, interchangeable functional attachments may be attached to the wheel assembly 18 or to the carrier assembly 50. To illustrate one example, FIGS. 12 and 13 show a pair of functional attachments in the form of a handle and brake lever. Although shown attached to the wheel assembly 18, the handle and brake lever attachments 214 may alternatively be mounted to the carrier assembly 50. FIG. 12 shows the device 10 with one handle and brake lever attachment 214 secured to the visible side of the wheel assembly 18. In this embodiment, the handle and brake lever attachment 214 includes a socket 216 fitted over the shaft 40. Although not shown, a mirror image handle and brake lever attachment 214 is secured to the shaft 40 on the hidden side of the mirror assembly 30. In this embodiment, the shaft 40 is a first linkage that ensures generally symmetrical motion of the affected and non-affect limbs along the track 20. As shown in FIG. 13, the handle and brake lever attachments 214 may be joined by a second linkage in the form of a cable 218. The cable 218 may be routed from one brake lever to the other such that compressive motion of the brake lever on the non-affected side results in compressive motion of the brake lever on the affected side (see cable routing in FIG. 13). Further, a spring 220 or other resilient component may be provided to bias the brake lever in the uncompressed position.

Figure 14:
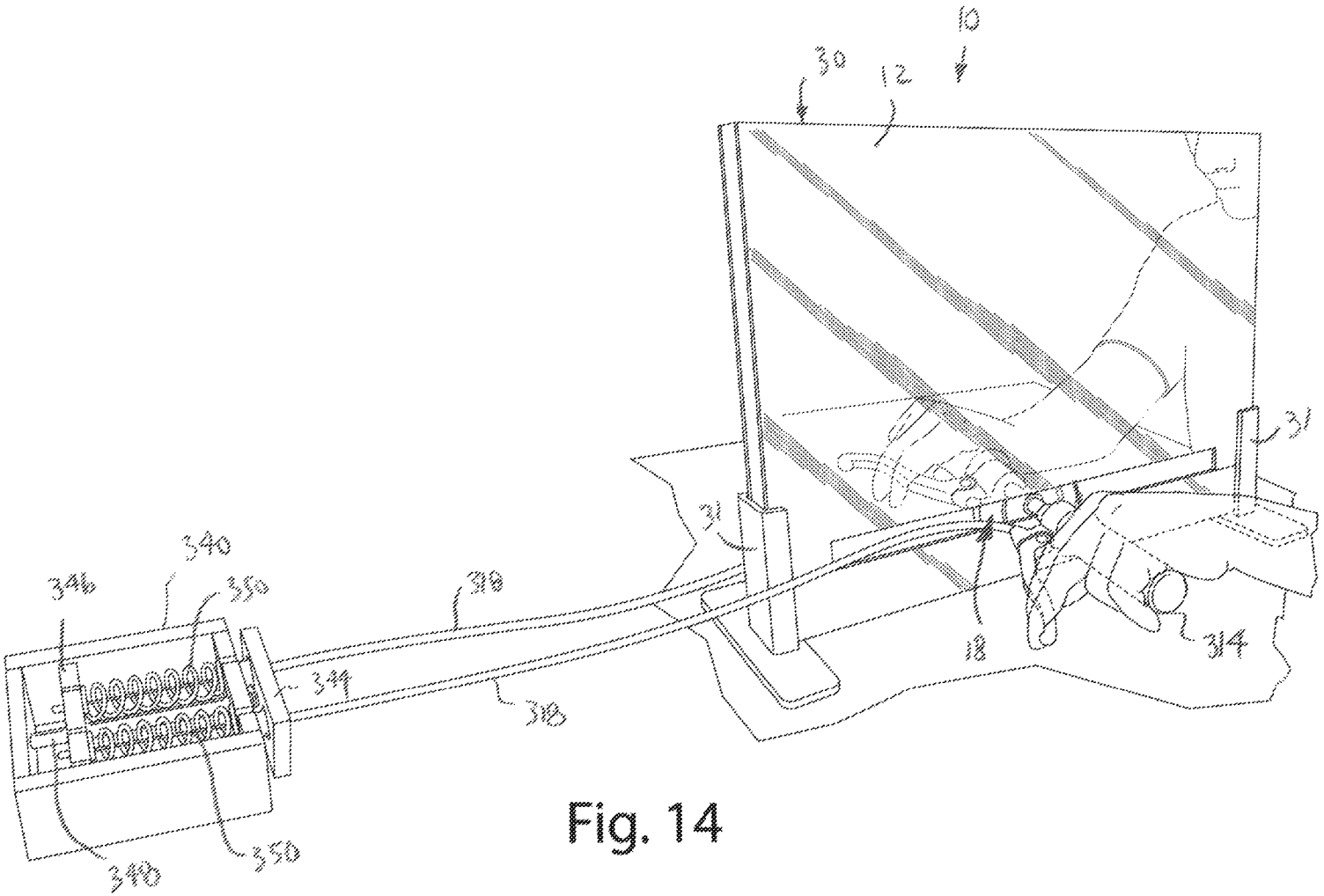
FIG. 14 is a perspective view of a patient using the device with an alternative handle and brake lever functional attachment.
Figure 15:
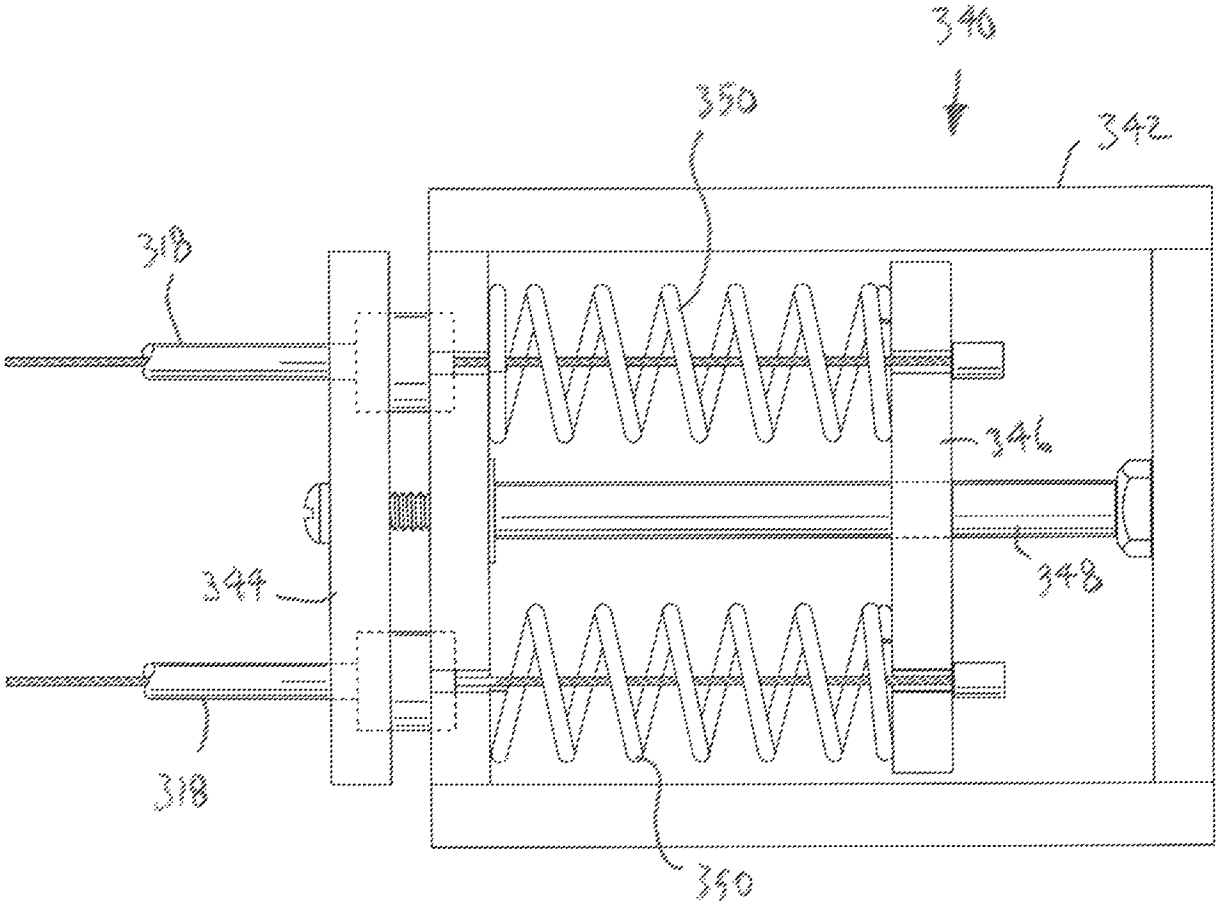
FIG. 15 is a top plan view of the tensioning assembly of FIG. 14.

An alternative embodiment of the handle and brake lever attachments 314 is shown in FIGS. 14 and 15. In this alternative embodiment, the handle and brake lever attachments 314 are joined by a linkage that generally includes a pair of cables 318 and a separate tensioning assembly 340. The tensioning assembly 340 biases the brake lever in the extended position and supplies the desired resistance to motion of the brake lever. The tensioning assembly 340 generally includes a housing 342, a head plate 344, a tail plate 346, a guide shaft 348 and a pair of springs 350. The cables 318 enter the housing 342 through head plate 344 and are joined to the tail plate 346. As shown, the cable sheaths are secured by the housing 342 and the cable ends are secured by the tail plate 346. The guide shaft 348 is rigidly secured within the housing 342 to provide a guide structure for the tail plate 346. The tail plate 346 is movably fitted over the guide shaft 350 such that the tail plate 346 can move along the length of the guide shaft 348 in response to actuation of a brake lever. The springs 350 are fitted between the housing 342 and the tail plate 346 to bias the cables 318 are provide the levers with tension. If desired, the tension of the tensioning assembly 340 may be adjustable to vary the resistance of the brake lever. In this embodiment, the linkage is configured so that actuation of the lever on the non-affected side reduces the resistance of the lever on the affected side, but does not mechanically actuate the lever on the affected side. The linkage can alternatively be configured so that movement of the lever engaged with the non-affected limb results in corresponding movement of the lever engaged with the affected limb.

Although not shown, in alternative embodiments one or both of the functional components may have integrated structure capable of selectively engaging/disengaging or coupling/decoupling the functional components from the linkage. For example, one or both of the functional components may be generally conventional reversible ratchet screwdriver handles (e.g. straight handle, T-shaped handle, L-shaped handle) configured to receive standardized hexagon drive attachments. The hexagon screwdriver handles may be installed over the hexagon attachment structures, and the reversible ratchet mechanism may be selectively operated to control how the two screwdriver handles interact. To illustrate, the reversible ratchet mechanisms on both screwdriver handles can be set to drive in both direction, which would cause the two screwdriver handles to move together when either handle is moved in either direction. Further, the screwdriver handles can be set to drive in clockwise or counterclockwise directions to provide different types of coupling, such as fully decoupling the two screwdriver handles or in coupling only in the clockwise or counterclockwise direction. In alternative embodiments, the conventional ratchet mechanism with unidirectional and bidirectional drive modes can be replaced by other mechanisms, such as a mechanism that can be actuated to rotationally couple or rotationally decouple the handle from the shaft. As an alternative to incorporating the mechanisms into the handles, the mechanisms may be incorporated into the mirror housing and/or the carrier assembly.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A mirror therapy device comprising:

a mirror having a reflective surface;

a first functional component movably disposed on a first side of said mirror, said reflective surface providing a reflected image of said first functional component;

a second functional component movably disposed on a second side of said mirror, said second functional component being hidden by said mirror; and a linkage operatively joining said first functional component to said second functional component, said linkage configured to cause said second functional component to move in a manner substantially consistent with said reflected image of said first functional component.

2. The device of claim 1 further including a mirror housing, said mirror secured to a major surface of said mirror housing.

3. The device of claim 2 further including a functional attachment structure movably supported by said mirror, said first functional component attached to said functional attachment structure on said first side, said second functional component attached to said functional attachment structure on said second side.

4. The device of claim 3 wherein said linkage is incorporated into said functional attachment structure, said functional attachment structure being a wheel assembly; and wherein said mirror housing includes a track movably supporting said wheel assembly.

5. The device of claim 1 further including a carrier assembly configured to be operatively associated with said mirror, said carrier assembly including:

a first functional component attachment structure movably supporting said first functional component and being disposed on said first side, and a second functional component attachment structure movably supporting said second functional component and being disposed on said second side.

6. The device of claim 5 wherein said carrier assembly includes a carrier assembly linkage operatively joining said first functional component attachment structure with said second functional component attachment structure, said carrier assembly linkage configured to cause said second functional component to move in a manner substantially consistent with said reflected image of said first functional component.

7. The device of claim 6 wherein said carrier assembly linkage includes a plurality of gear, said gears configured such that rotation of said first functional component in one direction results in rotation of said second functional component in an opposite direction.

8. The device of claim 1 further including a first functional component attachment structure configured to interchangeably receive one of a plurality of interchangeable functional components; and a second functional component attachment structure configured to interchangeably receive one of a plurality of interchangeable functional components.

9. The device of claim 1 wherein said first functional component is a first handle and brake assembly and said second functional component is a second handle and brake assembly; and wherein said linkage includes a cable operatively coupling said first handle and brake lever assembly and said second handle and brake lever assembly, whereby compression of said first handle and brake lever results in compression of said second handle and brake lever assembly or in a reduction of a force required to compress said second handle and brake lever assembly.

10. The device of claim 1 wherein said linkage is selectively disengagable to selectively decouple said first functional component and said second functional component.

11. The device of claim 1 further including adjustable resistance to movement of at least one of said first functional component and said second functional component.

12. The device of claim 5 wherein said carrier assembly and said mirror housing are configured to be intersecured in a plurality of different orientations.

13. The device of claim 1 further including attachment structure to secure an affected body part to said second functional component.

14. A mirror therapy device for use with a reflective surface comprising:

a first functional component situated on a first side of a reflective surface, said first functional component having a range of motion, whereby the reflective surface produces a reflected image of said first functional component throughout said range of motion;

a second functional component situated on a second side of the reflective surface opposite said first functional component, said second functional component not being visible from said first side of the reflective surface; and a symmetrical linkage operatively coupling said first functional component and said second functional component such that, when said first functional component is moved, said second functional component moves consistent with the reflected image of said first functional component.

15. The device of claim 14 further including a wheel assembly having a first functional component attachment removably receiving said first functional component and a second functional component attachment removably receiving said second functional component; and wherein said symmetrical linkage is incorporated into said wheel assembly and operatively connects said first functional component attachment and said second functional component attachment.

16. The device of claim 14 further including a carrier assembly having a first functional component attachment removably receiving said first functional component and a second functional component attachment removably receiving said second functional component; and wherein said symmetrical linkage is incorporated into said carrier assembly and operatively connects said first functional component attachment and said second functional component attachment.

17. The device of claim 14 further including a wheel assembly having a first wheel functional component attachment configured to removably receive said first functional component and a second wheel functional component attachment configured to removably receive said second functional component, wherein said symmetrical linkage includes a wheel assembly linkage incorporated into said wheel assembly, said wheel assembly linkage operatively connecting said first wheel functional component attachment and said second wheel functional component attachment; and further including a carrier assembly having a first carrier functional component attachment configured to removably receive said first functional component and a second carrier functional component attachment configured to removably receive said second functional component, wherein said symmetrical linkage includes a carrier assembly linkage incorporated into said carrier assembly, said carrier assembly linkage operatively connecting said first carrier functional component attachment and said second carrier functional component attachment.

18. A mirror therapy device comprising:

a mirror having a reflective surface, said mirror defining a visible side reflected in said reflective surface and a hidden side opposite said visible side;

a first functional component attachment situated on said visible side of said mirror;

a first functional component removably attached to said first functional component attachment, said first functional component being movable and configured for engagement with a non-affected body part;

a second functional component attachment situated on said hidden side of said mirror;

a second functional component removably attached to said second functional component attachment, said second functional component being movable and configured for engagement with an affected body part; and a linkage joining said first functional component and said second functional component such that, when said first functional component is moved by a non-affected body part, said second functional component moves an affected body part consistent with the reflected image of the non-affected body in the reflective surface.

19. The device of claim 18 further comprising a plurality of functional components capable of being interchangeably attached to said first functional component attachment and said second functional component attachment.

20. The device of claim 19 further including a carrier assembly configured to be operatively associated with said mirror, said first functional component attachment and said second functional component attachment being incorporated into said carrier assembly.

* * * * *